US006325881B1

(12) United States Patent
Ishibuchi et al.

(10) Patent No.: US 6,325,881 B1
(45) **Date of Patent: *Dec. 4, 2001**

(54) PHASE CONTROL METHOD AND SYSTEM FOR CORRUGATED FIBERBOARD SHEET COMPRISING A PLURALITY OF CORE PAPER LAYERS

(75) Inventors: Hiroshi Ishibuchi; Kazukiyo Kohno; Kuniaki Wakusawa; Yukuharu Seki; Makoto Ando, all of Hiroshima-ken (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/071,884

(22) Filed: May 5, 1998

(30) Foreign Application Priority Data

May 7, 1997 (JP) ..... 9-116826

(51) Int. Cl.[7] ..... B31F 1/28

(52) U.S. Cl. ..... 156/210; 156/64; 156/360; 156/361; 156/378; 156/470

(58) Field of Search ..... 156/470, 64, 361, 156/378, 462, 205, 210, 351, 360, 364; 242/419.9

(56) References Cited

U.S. PATENT DOCUMENTS

| | | | | |
|---|---|---|---|---|
| 3,700,518 | | 10/1972 | Ohmori | 156/152 |
| 3,711,688 | * | 1/1973 | Stout et al. | 235/151.1 |
| 3,856,607 | | 12/1974 | Faltot et al. | 156/351 |
| 3,981,758 | * | 9/1976 | Thayer et al. | 156/64 |
| 4,183,779 | | 1/1980 | Barber et al. | 156/361 |
| 4,795,513 | | 1/1989 | Jensen, Jr. | 156/108 |

FOREIGN PATENT DOCUMENTS

| | | |
|---|---|---|
| 0554911 A1 | 8/1993 | (EP) . |
| 9-29870 | 2/1997 | (JP) . |
| WO 92/15118 | 9/1992 | (WO) . |
| WO 96/27494 | 9/1996 | (WO) . |

OTHER PUBLICATIONS

Stephanopoulos, George. Chemical Process Control: An Introduction to Theory and Practice. PTR Prentice Hall. NJ. pp. 245–248, 265–278, 1984.*

* cited by examiner

*Primary Examiner*—Michael W. Ball
*Assistant Examiner*—Gladys Piazza
(74) *Attorney, Agent, or Firm*—Armstrong, Westerman, Hattori, McLeland & Naughton, LLP

(57) ABSTRACT

The present invention relates to a method capable of certainly correcting a phase shift between a plurality of core paper layers. In the method according to this invention, the next phase shift quantity $\delta'_3$ is estimated on the basis of a previous measured phase shift value $\delta_1$ and the present measured phase shift value $\delta_2$ and a single-faced corrugated fiberboard sheet tension changing quantity $\Delta T_1$ for correction of the next phase shift quantity $\delta'_3$ estimated is calculated to adjust the tension to the single-faced corrugated fiberboard sheet on the basis of the calculated tension changing quantity $\Delta T_1$. This invention is effectively applicable when, for example, manufacturing a two-layer core single-faced corrugated fiberboard sheet or the like.

6 Claims, 10 Drawing Sheets

PHASE CONTROL METHOD AND SYSTEM FOR CORRUGATED FIBERBOARD SHEET COMPRISING A PLURALITY OF CORE PAPER LAYERS

BACKGROUND OF THE INVENTION

1) Field of the Invention

The present invention relates to a phase control method and system for, when manufacturing a corrugated fiberboard sheet composed of a plurality of corrugated core paper layers, controlling a phase shift between the core paper.

2) Description of the Related Art

FIG. 6 is a cross sectional view showing a corrugated fiberboard sheet comprising a plurality of (for example, 2) core paper layers, and a double-faced corrugated fiberboard sheet S shown in FIG. 6 is made by adhering core paper $C_1$, $C_2$ constituting two layers to each other in a laminated (piled-up) condition between a pair of upper and lower liners $L_1$, $L_2$. The two core paper $C_1$, $C_2$ have crests (mountains) different in heights $H_1$, $H_2$ ($>H_1$) from each other, respectively, with the crests forming corrugated configurations with the same pitch $P_o$.

Referring to FIG. 7, a description will be made hereinbelow of an apparatus for manufacturing the double-faced corrugated fiberboard sheet S shown in FIG. 6.

FIG. 7 is a side elevational view illustratively and schematically showing a construction of a common corrugated fiberboard sheet manufacturing apparatus for manufacturing a double-faced corrugated fiberboard sheet S comprising two core paper $C_1$, $C_2$ layers.

In FIG. 7, omitted is a first single facer for manufacturing a single-faced corrugated fiberboard sheet $S_1$ in a manner that the first core paper $C_1$ shaped into a corrugated configuration is adhered onto the liner $L_1$, but shown is a second single facer SF2 for manufacturing a two-layer core single-faced corrugated fiberboard sheet $S_2$ in a manner of adhering the second core paper $C_2$ having a corrugated configuration with the same pitch as that of the first core paper $C_1$ onto the single-faced corrugated fiberboard sheet $S_1$ in a laminated condition, and further shown is a double facer DF for manufacturing a double-faced corrugated fiberboard sheet S in a way of adhering the liner $L_2$ onto the two-layer core single-faced corrugated fiberboard sheet $S_2$ manufactured by the second single facer SF2.

The second single facer SF2 is composed of guide rolls 1, 2, preheating rolls 3, 4, an endless pressure belt 5, drive rolls 6, 7, an upper roll 8, a lower roll 9, a paste reservoir 10 and paste applying rolls 11, 12.

The guide rolls 1, 2 and the preheating rolls 3, 4 are for the purpose of guiding the single-faced corrugated fiberboard sheet $S_1$ coming from the non-shown first single facer to between the pressure belt 5 and the upper roll 8, while the preheating rolls 3, 4 also have a function to preheat the single-faced corrugated fiberboard sheet $S_1$.

The endless pressure belt 5 is wound around the drive rolls 6, 7 to be rotationally driven therethrough. In addition, the upper roll 8 is placed into contact with the endless pressure belt 5 stretched between the drive rolls 6, 7 to pressurize it from the below. Moreover, under the upper roll 8, there is disposed the lower roll 9 for shaping the second core paper $C_2$ into a corrugated configuration in a manner that the second core paper $C_2$ is put between the upper roll 8 and the lower roll 9.

The paste reservoir 10 holds a paste to be used for adhering the second core paper $C_2$ onto the single-faced corrugated fiberboard $S_1$, and the paste applying rolls 11, 12 apply the paste within the paste reservoir 10 onto peak portions of the crests of the second core paper $C_2$ shaped into a corrugated configuration in a manner of being put between the upper roll 8 and the lower roll 9.

Between the endless pressure belt 5 and the upper roll 8, there is interposed the single-faced corrugated fiberboard $S_1$, and at the same time, there is put the second core paper $C_2$ shaped into a corrugated configuration between the upper roll 8 and the lower roll 9 and undergoing the paste application. In this way, the second core paper $C_2$ is pasted on the single-faced corrugated fiberboard sheet $S_1$, thus manufacturing the two-layer core single-faced corrugated fiberboard sheet $S_2$.

Furthermore, the second single facer SF2 is provided with a tension adjusting unit 17 for adjusting a tension to be given to the single-faced corrugated fiberboard sheet $S_1$. The tension adjusting unit 17 is, for example, made up of a suction box (not shown) for sucking the single-faced corrugated fiberboard sheet $S_1$ from the liner $L_1$ side, with the tension to the single-faced corrugated fiberboard sheet $S_1$ being adjusted by the adjustment of that suction force (the frictional resistance force for the single-faced corrugated fiberboard sheet $S_1$).

In addition, provided is a pulse sensor 22 for sensing, as a pulse signal, the crests of the first core paper $C_1$ of the single-faced corrugated fiberboard sheet $S_1$ to be interposed between the endless pressure belt 5 and the upper roll 8, and further provided is a pulse sensor 23 for sensing, as a pulse signal, the crests of the second core paper $C_2$ to be put between the endless pressure belt 5 and the upper roll 8. These pulse sensors 22, 23 constitute a phase shift measuring unit 18 for measuring a phase shift quantity $\delta$ between the crests of the first core paper $C_1$ and the crests of the second core paper $C_2$.

On the basis of the phase shift quantity $\delta$ measured by the phase shift measuring unit 18, a tension control unit 19 controls the tension to the single-faced corrugated fiberboard sheet $S_1$ through the tension adjusting unit 17 so that the phase shift quantity $\delta$ becomes zero. An tension control operation by this tension control unit 19 will be described herein later with reference to FIGS. 8 and 9.

Incidentally, in fact, the tension control unit 19 adjusts the suction force to the single-faced corrugated fiberboard sheet $S_1$ caused by the suction box organizing the tension adjusting unit 17, so that the single-faced corrugated fiberboard sheet $S_1$ is adjustable to achieve the adjustment of the phase of the first core paper $C_1$ on the single-faced corrugated fiberboard sheet $S_1$ side.

On the other hand, the two-layer core single-faced corrugated fiberboard sheet $S_2$ manufactured by the second signal facer SF2 is guided by the guide rolls 13*a*, 13*b* toward a double facer DF. This double facer DF is composed of pressure rolls 15, 16, and the two-layer core single-faced corrugated fiberboard sheet $S_2$, together with the liner $L_2$ guided by a guide roll 14, is placed between the pressure rolls 15, 16, thus manufacturing the double-faced corrugated fiberboard sheet S.

In the corrugated fiberboard sheet manufacturing apparatus thus constructed, the single-faced corrugated fiberboard sheet $S_1$ produced by the first single facer (not shown) is conveyed through a path (not shown) to the second single facer SF2.

In this second single facer SF2, the single-faced corrugated fiberboard sheet $S_1$ is guided by the guide rolls 1, 2 and the preheating rolls 3, 4 to be delivered to between the pressure belt 5 and the upper roll 8. The single-faced corrugated fiberboard sheet $S_1$ is preheated when passing through the outer circumferences of the preheating rolls 3, 4.

On the other hand, the second core paper $C_2$ is shaped into a corrugated configuration when passing through between the upper roll 8 and the lower roll 9 in a state of being interposed therebetween, and after a paste is applied onto the crest peak portions of the corrugated configuration by means of the paste applying rolls 11, 12, the second core paper $C_2$, together with the single-faced corrugated fiberboard sheet $S_1$, is conveyed to between the pressure roll 5 and the upper roll 8. Further, the single-faced corrugated fiberboard sheet $S_1$ and the second core paper $C_2$, being in a laminated condition, are subjected to given heating and pressing force, so that the second core paper $C_2$ is adhered onto with the single-faced corrugated fiberboard sheet $S_1$, thereby manufacturing the single-faced corrugated fiberboard sheet $S_2$. In this case, the crests of the second core paper $C_2$ are formed to have a height higher than that of the crests of the first core paper $C_1$.

At this time, the phase shift measuring unit 18 measures the phase shift quantity $\delta$ between the corrugated configuration of the first core paper $C_1$ of the single-faced corrugated fiberboard sheet $S_1$ and the corrugated configuration of the second core paper $C_2$ to be adhered to the first core paper $C_2$ and feedbacks the phase shift quantity $\delta$ being the detection results of the pulse sensors 22, 23 to the tension control unit 19 which in turn, adjusts the tension to the single-faced corrugated fiberboard sheet $S_1$ through the use of the tension adjusting unit 17.

Referring to FIGS. 8A to 8C, a description will be taken hereinbelow of a prior method of calculating a sheet tension changing quantity on the basis of the phase shift quantity $\delta$ measured.

If a phase shift quantity $\delta_2$ is obtained as the present measured value as shown in FIG. 8A, a sheet distortion quantity $\Delta\epsilon^*_1$ for setting the phase shift quantity $\delta$ to zero is obtained as shown in FIG. 8B. Subsequently, as shown in FIG. 8C, the distortion quantity $\Delta\epsilon^*_1$ is divided by a sheet distortion quantity K per a tension of 1 kgf/cm so that a sheet tension changing quantity $\Delta T_1$ for the correction (or modification) of the phase shift is calculated as $\Delta\epsilon^*_1/K$.

In this case, a phase shift occurs by $\Delta a$ during a measurement interval L from the measurement of the phase shift quantity $\delta_2$ to the measurement of the next phase shift quantity $\delta_3$. Accordingly, even if adding the aforesaid sheet tension changing quantity $\Delta T_1$, the next phase shift quantity $\delta_3$ does not reach zero, but assumes a quantity $\delta_3$ (=$-\Delta a$) shifted by the phase shift quantity $\Delta a$ from zero. As shown in FIG. 8A, the phase shift quantity $\Delta a$ takes place at a given inclination even in the case of not conducting the phase control, and in the case of no phase control, the phase shift quantity $\Delta'_3$ after the elapse of the measurement interval L comes to $\delta_2-\Delta a$.

Referring to the flow chart (steps T1 to T4) of FIG. 9, a description will be made hereinbelow of a phase control procedure based upon the above-mentioned sheet tension changing quantity calculating method.

First, for instance, if the phase shift quantity $\delta_2$ shown in FIG. 8A is measured as the present measured value by the measuring unit 18 (the pulse sensors 22, 23) (step T1), the tension control unit 19 decides whether or not the phase shift quantity $\delta_2$ is within an allowable range (step T2). If being within the allowable range (YES route from step T2), the operational flow returns to the step T1 to perform the next measurement after the elapse of the phase shift measurement interval L.

On the contrary, if the present phase shift quantity $\delta_2$ is out of the allowable range (NO route from step T2), the tension control unit 19 calculates the phase shift correction sheet tension changing quantity $\Delta T_1$ as $\Delta\epsilon^*_1/K$ as mentioned above with reference to FIG. 8C (step T3), and controls a braking unit 21 constituting the tension adjusting unit 17 by a quantity corresponding to the tension changing quantity $\Delta T_1$ to alter the tension to the single-faced corrugated fiberboard sheet $S_1$ (step T4).

Besides, the phase shift quantity $\delta_1$ shown in FIG. 8A represents an example of phase shift quantities immediately before the phase control by the repetitions of the steps T1 to T4 shown in FIG. 9, and is shown for the purpose of facilitating the comparison with a phase control method according to an embodiment of this invention which will be described herein later with reference to FIGS. 1A to 1C, and in this case, the phase control is not conducted on the basis of the phase shift quantity $\delta_1$.

The phase shift occurs due to the difference between the crest pitches of the core paper $C_1$ and the core paper $C_2$. That is, as shown in FIG. 10, if the crest pitch $P_2$ of the core paper $C_2$ is smaller than the crest pitch $P_1$ of the core paper $C_1$, a phase shift $+\delta$ occurs, with the result that a shift between the corrugated configurations of the core paper $C_1$ and the core paper $C_2$ takes place when being piled up on each other. On the other hand, as shown in FIG. 11, if the crest pitch $P_2$ of the core paper $C_2$ is larger than the crest pitch $P_1$ of the core paper $C_1$, a phase shift $-\delta$ occurs, with the result that a shift between the corrugated configurations of the core paper $C_1$ and the core paper $C_2$ also takes place when being piled up on each other.

When the above-mentioned shift between the corrugated configurations of the core paper $C_1$ and the core paper $C_2$ takes place in bonding them together, difficulty is experienced to appropriately adhere the core paper $C_1$ and the core paper $C_2$ to each other, which makes it difficult to form an appropriate single-faced corrugated fiberboard sheet $S_2$.

Thus, a corrugated fiberboard sheet including a plurality of core paper layers which are appropriately adhered to each other can not fulfill the original function of the corrugated fiberboard sheet with a plurality of core paper layers for the cushioning effect and strength increase, and is defective as a product.

For this reason, as described with reference to FIGS. 8A to 8C and 9, in a manner of measuring the phase shift quantity $\delta$ to adjust the tension to the single-faced corrugated fiberboard $S_1$ on the basis of the phase shift quantity $\delta$, the phase shift feedback control is done.

However, as also mentioned before with reference to FIGS. 8A to 8C, in the case of the prior phase control method, since the tension changing quantity $\Delta T_1$ for the correction of the present phase shift quantity $\delta_2$ (putting it to zero) is simply calculated using only the present phase shift quantity $\delta_2$ by the current measurement, a phase shift occurs during the tension alteration (the measurement interval L), with the result that it is difficult to completely correct the phase shift.

More specifically, since the phase shift occurs by $\Delta a$ during the measurement interval L (that is, during the tension alteration) from the time of the measurement of the phase shift quantity $\delta_2$ to the time that the next phase shift quantity $\delta_3$ is measured as the present measured value $\delta_2$, even if adding the tension changing quantity $\Delta T_1$ calculated as $\Delta\epsilon^*_1/K$, the next phase shift quantity $\delta_3$ does not come to zero, but shifts by the phase shift quantity $\Delta a$ from zero, which makes it difficult to fully correct the phase shift.

SUMMARY OF THE INVENTION

The present invention has been developed in order to eliminate this problem, and it is therefore an object of this invention to provide a phase control method and system for a corrugated fiberboard sheet with a plurality of core paper layers which are capable of certainly correcting the phase shift between the plurality of core paper layers, thereby manufacturing a high-quality corrugated fiberboard sheet with a plurality of core paper layers.

For this purpose, in accordance with the present invention, there is provided a phase control method for a corrugated fiberboard sheet with a plurality of core paper layers in which, when manufacturing the corrugated fiberboard sheet with the plurality of core paper layers in a manner that, after a single-faced corrugated fiberboard sheet is formed by adhering first core paper shaped into a corrugated configuration, second core paper shaped into a corrugated configuration is adhered onto the single-faced corrugated fiberboard sheet from the first core paper side in a laminated condition, a phase shift between the corrugated configuration of the first core paper and the corrugated configuration of the second core paper is measured to adjust a tension to be applied to the single-faced corrugated fiberboard sheet on the basis of the measured phase shift value for phase control of the corrugated configuration of the first core paper and the corrugated configuration of the second core paper, wherein, the next phase shift quantity is estimated on the basis of a previous measured phase shift value and the present measured phase shift value, and a single-faced corrugated fiberboard sheet tension changing quantity for correction of the next phase shift quantity estimated is calculated to adjust the tension to the single-faced corrugated fiberboard sheet on the basis of the calculated tension changing quantity.

Furthermore, in accordance with the present invention, there is provided a phase control system for a corrugated fiberboard sheet with a plurality of core paper layers for performing phase control for a corrugated configuration of first core paper and a corrugated configuration of second core paper when manufacturing the corrugated fiberboard sheet with the plurality of core paper layers in a manner that, after a single-faced corrugated fiberboard sheet is formed by adhering the first core paper shaped into the corrugated configuration, the second core paper shaped into a corrugated configuration is adhered onto the single-faced corrugated fiberboard sheet from the first core paper side in a laminated condition, the system being composed of phase shift measuring means for measuring a phase shift between the corrugated configuration of the first core paper and the corrugated configuration of the second core paper, tension adjusting means for adjusting a tension to be applied to the single-faced corrugated fiberboard sheet, and tension control means for controlling the tension adjusting means to change and adjust the tension to the single-faced corrugated fiberboard sheet on the basis of a phase shift value measured by the phase shift measuring means, with the tension control means estimating the next phase shift quantity on the basis of a previous measured phase shift value and the present measured phase shift value, calculating a changing quantity of the tension to the single-faced corrugated fiberboard sheet for correction of the next phase shift quantity estimated and controlling the tension adjusting means to adjust the tension to the single-faced corrugated fiberboard sheet on the basis of the calculated tension changing quantity.

Thus, in the phase control method and system for a corrugated fiberboard sheet with a plurality of core paper layers according to this invention, considering the phase shift quantity occurring during the change of the tension, the next phase shift quantity is estimated on the basis of the previous measured phase shift value and the present measured phase shift value, and the tension changing quantity for the correction of the estimated value is calculated so that the tension to the single-faced fiberboard sheet is adjusted by a quantity corresponding to the tension changing quantity. With only these operations, it is possible to make the next phase shift quantity become zero. Accordingly, the phase shift between the plurality of core paper layers is surely correctable so that it is possible to manufacture a high-quality corrugated fiberboard sheet with a plurality of core paper layers.

DESCRIPTION OF THE PREFERRED EMBODIMENTS

Embodiments of the present invention will be described hereinbelow with the drawings.

[A] Description of First Embodiment

Figure 3:
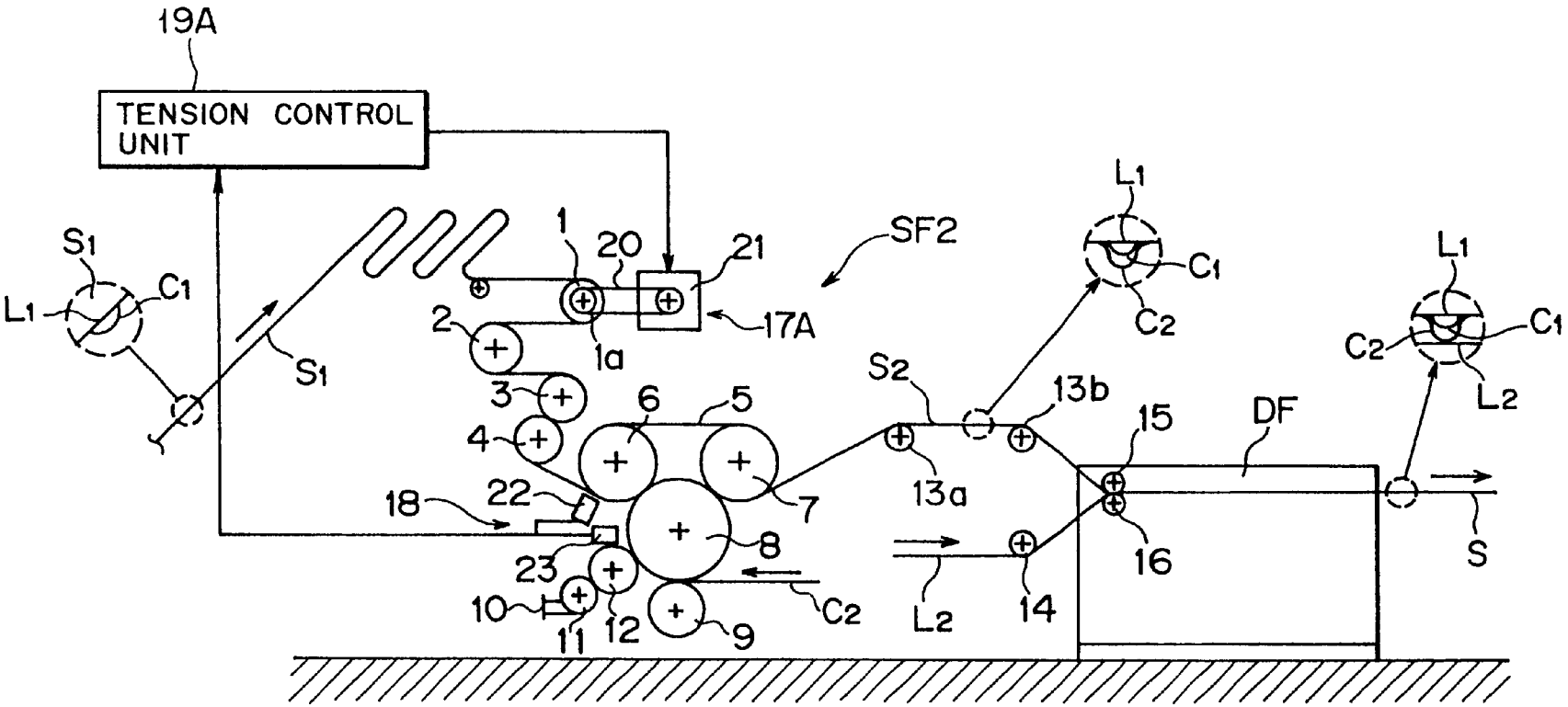
FIG. 3 is a side elevational view illustratively and schematically showing a construction of a corrugated fiberboard sheet manufacturing apparatus equipped with a phase control system according to the first embodiment of this invention.
Figure 6:
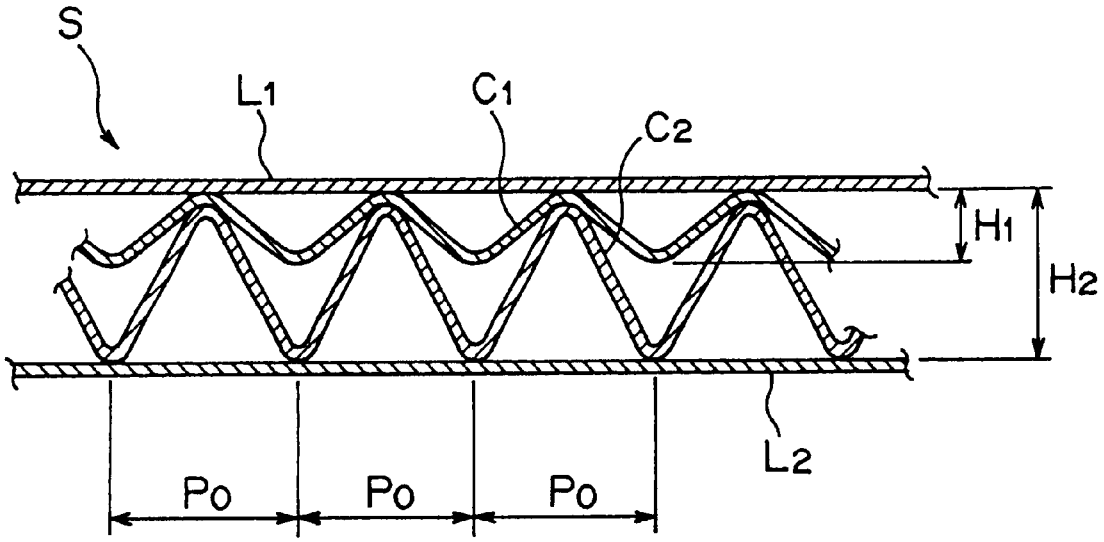
FIG. 6 PRIOR ART
FIG. 6 is a cross-sectional view showing a double-faced corrugated fiberboard sheet with two core paper layers.

First, referring now to FIG. 3, a description will be made hereinbelow of a schematic construction of a corrugated fiberboard sheet manufacturing apparatus equipped with a phase control system according to a first embodiment of this invention. In FIG. 3, the same numerals as those used above represent the same or substantially same parts. In this embodiment, the corrugated fiberboard sheet manufacturing apparatus is designed to manufacture, for example, a double-faced corrugated fiberboard sheet S shown in FIG. 6 as in the case of the prior art.

In FIG. 3, omitted is a first single facer for manufacturing a single-faced corrugated fiberboard sheet $S_1$ in a manner that first core paper $C_1$ shaped into a corrugated configuration is adhered onto a liner $L_1$, but shown is a second single facer SF2 for manufacturing a two-layer core single-faced corrugated fiberboard sheet $S_2$ in a manner of adhering second core paper $C_2$ having a corrugated configuration with the same pitch as that of the first core paper $C_1$ onto the single-faced corrugated fiberboard sheet $S_1$ in a laminated condition, and further shown is a double facer DF for manufacturing a double-faced corrugated fiberboard sheet S in a way of adhering a liner $L_2$ onto the two-layer core single-faced corrugated fiberboard sheet $S_2$ manufactured by the second single facer SF2.

The second single facer SF2 is composed of guide rolls 1, 2, preheating rolls 3, 4, an endless pressure belt 5, drive rolls 6, 7, an upper roll 8, a lower roll 9, a paste reservoir 10 and paste applying rolls 11, 12. The detailed description thereof will be omitted because of being similar to those shown in FIG. 7.

In this embodiment, in place of the tension adjusting unit 17 comprising a suction box, there is provided a tension adjusting unit (tension adjusting means) 17 which will be mentioned later. That is, a transmission belt 20 is wound around a rotary shaft 1*a* of the guide roll 1, and a braking unit 21 for applying a braking force is coupled through the transmission belt 20 to the guide roll 1. The braking unit 21, the transmission belt 20, the guide roll 1 and others organize the tension adjusting unit 17A for adjusting the tension to the single-faced corrugated fiberboard sheet $S_1$ to be fed to the second signal facer SF2. Incidentally, as the braking unit 21, there is used an electromagnetic brake such as a powder brake.

Figure 4:
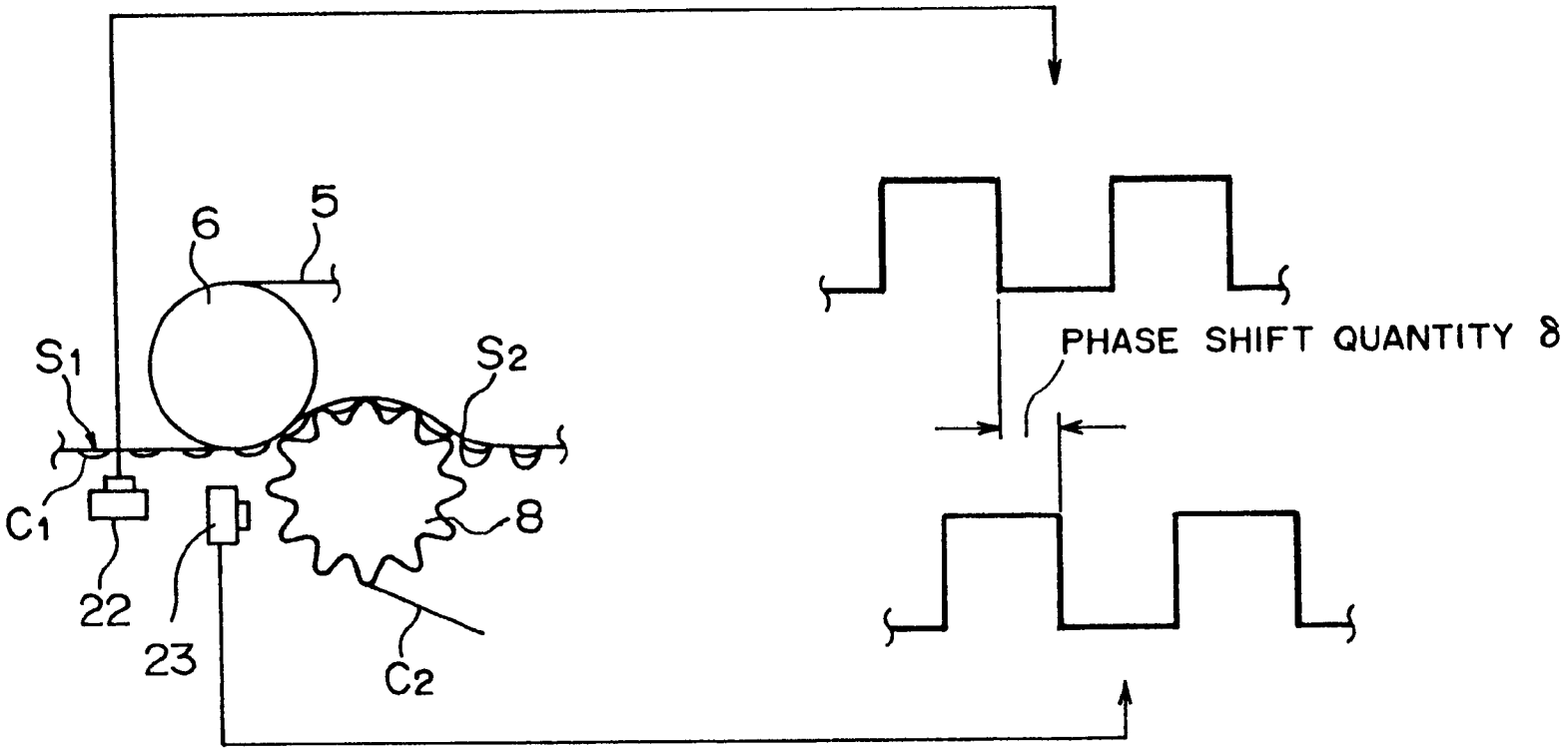
FIG. 4 is an illustration for describing a measurement principle for a phase shift measuring unit in the first embodiment of this invention.

Furthermore, as shown in FIGS. 3 and 4, there is provided a pulse sensor 22 for detecting, as a pulse signal, the crest pitch of the first core paper $C_1$ of the single-faced corrugated fiberboard sheet $S_1$ to be interposed between the endless pressure belt 5 and the upper roll 8, and further provided is a pulse sensor 23 for detecting, as a pulse signal, the crests of the second core paper $C_2$ of the single-faced corrugated fiberboard sheet $S_1$ to be put between the endless pressure belt 5 and the upper roll 8. These pulse sensors 22, 23 compose a phase shift measuring unit (phase shift measuring means) 18 for measuring the phase shift quantity δ between the crests of the first core paper $C_1$ and the crests of the second core paper $C_2$.

That is, as shown in FIG. 4, the phase shift measuring unit 18 in this embodiment is designed to measure the phase shift quantity δ between the crests of the first core paper $C_1$ and the crests of the second core paper $C_2$ as the phase difference between a first core paper $C_1$ crest pulse signal detected by the pulse sensor 22 and a second core paper $C_2$ crest pulse signal detected by the pulse sensor 23.

Furthermore, placed is a tension control unit (tension control means) 19A for controlling the tension to the single-faced corrugated fiberboard sheet $S_1$ through the use of a tension adjusting unit 17A on the basis of the phase shift quantity δ measured by the phase shift measuring unit 18 so that the phase shift quantity δ becomes zero. An tension control operation by this tension control unit 19A will be described herein later with reference to FIGS. 1 and 2.

Incidentally, in fact, the tension control unit 19A adjusts the braking force by the braking unit 21 constituting the tension adjusting unit 17A to make the braking force work on the guide roll 1 through the transmission belt 20, so that the tension to the single-faced corrugated fiberboard sheet $S_1$ is adjustable and the phase of the first core paper $C_1$ on the single-faced corrugated fiberboard sheet $S_1$ side is adjustable.

The aforesaid tension adjusting unit 17A, phase shift measuring unit 18 and tension control unit 19A organize a phase control unit according to the first embodiment of this invention.

On the other hand, the two-layer core single-faced corrugated fiberboard sheet $S_2$ manufactured in the second single facer SF2 is guided by guide rolls 13*a*, 13*b* to be fed to the double facer DF. This double facer DF is equipped with pressure rolls 15, 16, and the two-layer core single-faced corrugated fiberboard sheet $S_2$ and a liner $L_2$ guided by a guide roll 14 are put between the pressure rolls 15, 16, thereby manufacturing a double-faced corrugated fiberboard sheet S.

Also in the corrugated fiberboard sheet manufacturing apparatus according to the first embodiment thus constructed, the single-faced corrugated fiberboard sheet $S_1$ produced by the non-shown first single facer is conveyed through a non-shown path to the second single facer SF2.

In this second single facer SF2, the single-faced corrugated fiberboard sheet $S_1$ is guided by the guide rolls 1, 2 and the preheating rolls 3, 4 to be conveyed to between the pressure belt 5 and the upper roll 8. The single-faced corrugated fiberboard sheet $S_1$ is preheated while passing through the outer circumferences of the preheating rolls 3, 4.

Meanwhile, the second core paper $C_2$ passes through between the upper roll 8 and the lower roll 9 in an interposed condition to be shaped into a corrugated configuration, and after a paste is applied to the crest peak portions thereof by means of the paste applying rolls 11, 12, the second core paper $C_2$, together with the single-faced corrugated fiberboard sheet $S_1$, is conveyed to between the pressure belt 5 and the upper roll 8. Subsequently, the single-faced corrugated fiberboard sheet $S_1$ and the second core paper $C_2$ are subjected to given heating and pressing force in a laminated condition, so that the second core paper $C_2$ is adhered to the single-faced corrugated fiberboard sheet $S_1$ to manufacture a single-faced corrugated fiberboard sheet $S_2$. The crests of the second core paper $C_2$ are made to be higher in height than the crests of the first core paper $C_1$.

At this time, the phase shift measuring unit 18 measures the phase shift quantity δ between the corrugated configuration of the first core paper $C_1$ of the single-faced corrugated fiberboard sheet $S_1$ and the corrugated configuration of the second core paper $C_2$ to be adhered to the first core paper $C_1$, and feedbacks the phase shift quantity δ being the detection results of the pulse sensors 22, 23 to the tension control unit 19A which in turn, adjusts the tension to the single-faced corrugated fiberboard sheet $S_1$ through the use of the tension adjusting unit 17A.

Referring to FIGS. 1A to 1D, a description will be made hereinbelow of a method of calculating a sheet tension changing quantity on the basis of the measured phase shift value δ in this embodiment. FIGS. 1A to 1D are illustrations useful for describing a phase control method for a corrugated fiberboard sheet with a plurality of core paper layers (a method of calculating a sheet tension changing quantity on the basis of a measured phase shift value) according to the first embodiment of this invention.

In this invention, the next phase shift quantity $\delta'_3$ is estimated on the basis of a previous measured phase shift value $\delta_1$ and the present measured phase shift value $\delta_2$, and a tension changing quantity $\Delta T_1$ is obtained to correct the estimated phase shift quantity $\delta'_3$, before the tension alteration is done.

Figure 1A:
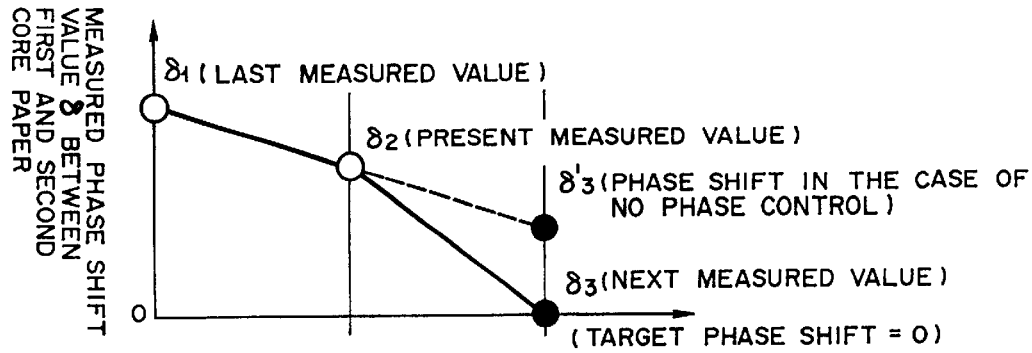
FIGS. 1A to 1D are illustrations useful for describing a phase control method for a corrugated fiberboard sheet with a plurality of core paper layers (a method of calculating a sheet tension changing quantity on the basis of a measured phase shift value) according to a first embodiment of the present invention.
Figure 1B:
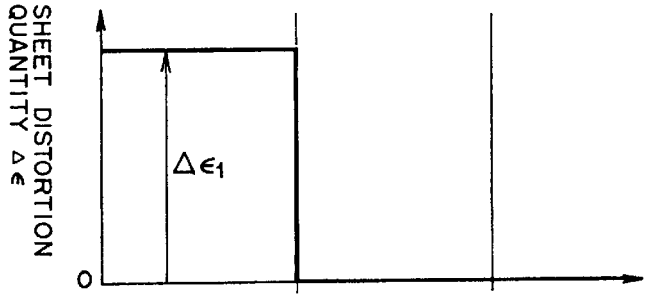
Figure 1C:
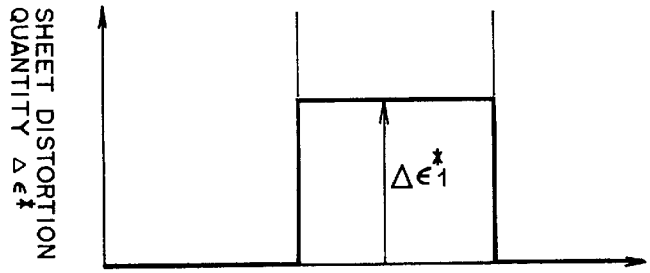

That is, if, as shown in FIG. 1A, the phase shift quantity $\delta_1$ is obtained as the last measured value and the phase shift quantity $\delta_2$ is obtained as the present measured value, a sheet distortion quantity $\Delta\epsilon_1$ corresponding to the phase shift quantity $\Delta_1$ is obtained as shown in FIG. 1B, and further, a sheet distortion quantity $\Delta\epsilon^*_1$ corresponding to the phase shift value $\delta_2$ is obtained as shown in FIG. 1C.

In the case that a phase shift occurs between the first core paper $C_1$ and the second core paper $C_2$, the phase commonly varies at a given inclination if not conducting the phase control. For this reason, if the phase control is not done at the time of the measurement of the present phase shift quantity $\delta_2$, the phase shift quantity varies at a given inclination, and as shown in FIG. 1A, the next phase shift quantity after the phase shift measurement interval L is estimated to assume $\delta'_3$.

Figure 1D:
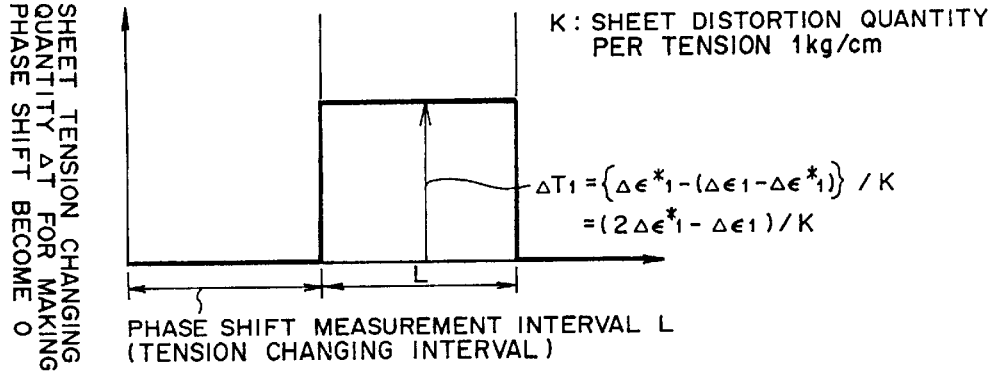

Accordingly, the sheet distortion quantity to be corrected until the time of the next phase shift measurement can be calculated as a sheet distortion quantity corresponding to the phase shift quantity $\delta'_3$ in the case of no control, that is, a quantity obtained by subtracting $(\Delta\epsilon_1-\Delta\epsilon^*_1)$ from $\Delta\epsilon^*_1$. Further, as shown in FIG. 1D, in a manner of dividing the sheet distortion quantity $[\Delta\epsilon^*_1-(\Delta\epsilon_1-\Delta\epsilon^*_1)]$ by a sheet distortion quantity K per a tension of 1 kgf/cm, a sheet tension changing quantity $\Delta T_1$ for the correction of the next phase shift (corresponding to $\delta'_3$ in FIG. 1A) is attainable as the following equation (1).

$$\Delta T_1 = [\Delta\varepsilon_1^* - (\Delta\varepsilon_1 - \Delta\varepsilon_1^*)]/K \quad (1)$$
$$= (2\Delta\varepsilon_1^* - \Delta\varepsilon_1)/K$$

Since the sheet tension changing quantity $\Delta T_1$ based upon this equation (1) is determined considering the quantity of the phase shift occurring during the tension change (during the phase shift measurement interval L), when the tension control unit 19A controls the tension adjusting unit 17A to apply the sheet tension changing quantity $\Delta T_1$ to the single-faced corrugated fiberboard sheet $S_1$, so that the next phase shift quantity $\delta_3$ after the elapse of the measurement interval L becomes zero, that is, the phase shift is correctable.

The phase shift measurement interval L varies in accordance with the sheet conveyance speed, the control response, the precision prescribe and others, and is set appropriately on all such occasions. For instance, assuming that the sheet conveyance speed is at 300 m/minute and the measurement is made every 1 m, the phase shift measurement interval L becomes (1/300)×60 seconds =0.2 second.

Figure 2:
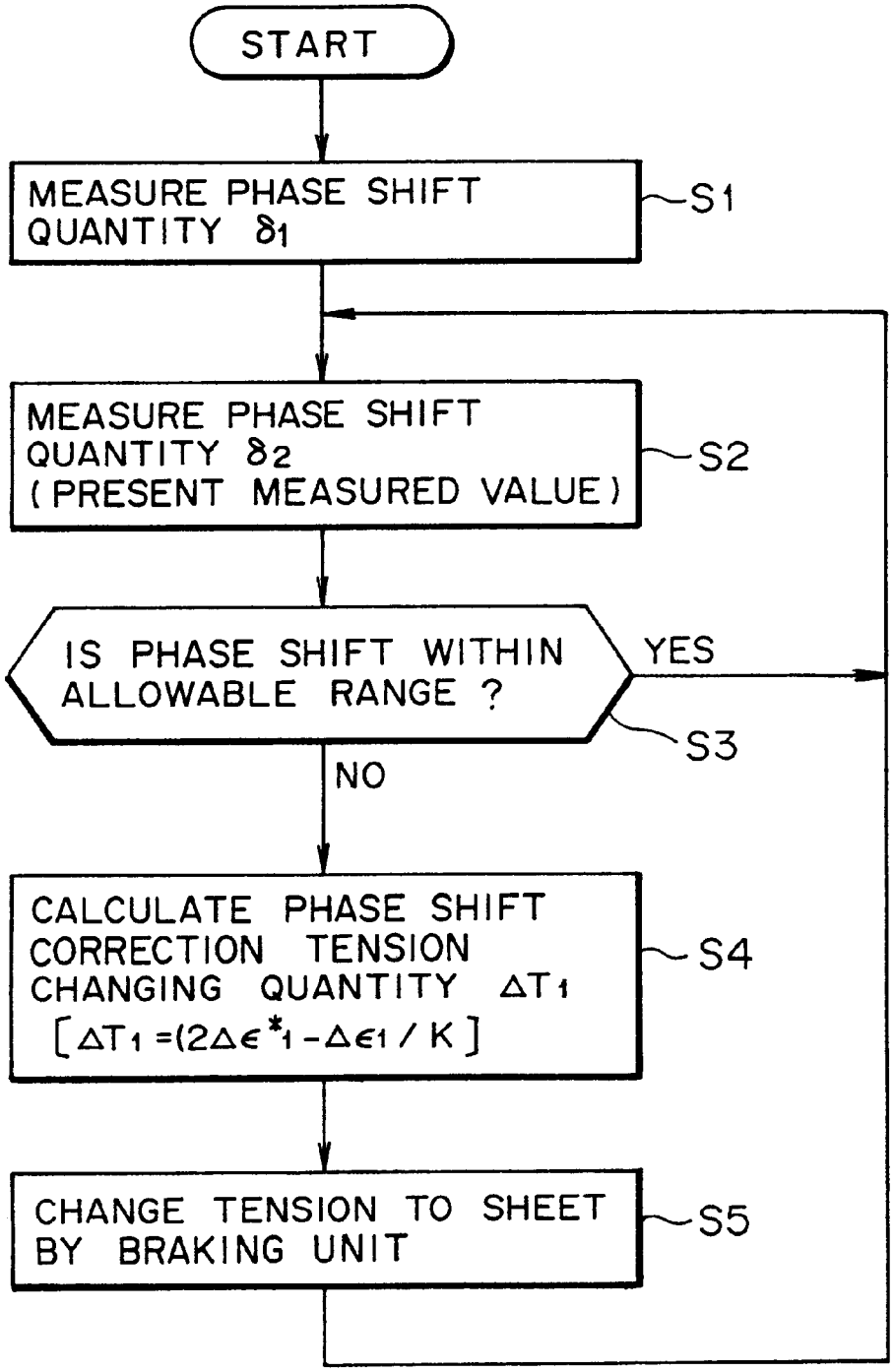
FIG. 2 is a flow chart available for explaining a phase control procedure according to the first embodiment of this invention.

Referring to the flow chart (steps S1 to S5) of FIG. 2, a description will be taken hereinbelow of a phase control procedure based upon the above-mentioned sheet tension changing quantity calculating method.

For starting the phase control, the phase shift measuring unit 18 (pulse sensors 22, 23) first measures a phase shift quantity $\delta_1$ between the corrugated configuration of the first core paper $C_1$ and the corrugated configuration of the second core paper $C_2$ (step S1) at the beginning of the control, and thereafter, the phase shift measuring unit 18 (pulse sensors 22, 23) measures a phase shift quantity $\delta_2$ as the present measured value at every phase shift measurement interval L (step S2).

In the step S2, whenever the present measured value $\delta_2$ is obtained at every phase shift measurement interval L, the tension control unit 19A makes a decision as to whether or not the phase shift quantity $\delta_2$ is within an allowable range (step S3). If being within the allowable range (YES route from step S3), the operational flow returns to perform the next measurement after the elapse of the phase shift measurement interval L.

On the other hand, if the present measured value $\delta_2$ is out of the allowable range (NO route from step S3), the tension control unit 19A calculates a sheet tension changing quantity $\Delta T_1$ for the phase shift correction in accordance with the aforesaid equation (1) as mentioned before with reference to FIG. 1D (step S4), and controls the braking unit 21 constituting the tension adjusting unit 17A by the tension changing quantity $\Delta T_1$ to alter the tension to the single-faced corrugated fiberboard sheet $S_1$ (step S5).

With this tension adjustment, the expansion/contraction quantity of the single-faced corrugated fiberboard sheet $S_1$ is adjusted to conduct the pitch change of the core paper $C_1$, so that the phase shift quantity between the core paper $C_1$ and the core paper $C_2$ is correctable.

When immediately calculating the tension changing quantity $\Delta T_1$ in the step S4 at the beginning of the control, the last measured value $\delta_1$ measured in the step S1 and the present measured value $\delta_2$ measured in the step S2 are used, whereas, after the start of the control and the start of the loop operations of the steps S2 to S5, the phase shift quantity $\delta_2$ measured in the step S2 at the last measurement timing is replaced with the last measured value $\delta_1$, and the operation in the step S4 (calculation of the phase shift correction tension changing quantity $\Delta T_1$) is executed.

In calculating the tension changing quantity $\Delta T_1$ in the step S4, in case that the last measured value $\delta_1$ contains some measurement errors (in case that the pulses corresponding to the core paper corrugated configuration are not given by the pulse sensors 22, 23 so that it is impossible to measure the phase shift quantity), the measure value prior to that measurement is used as the last measured value $\delta_1$. However, in case where an measurement error occurs in the step S1, the operation in the step 1 is repeatedly executed until the initial phase shift quantity $\delta_1$ is measured.

Furthermore, in the aforesaid equation (1) for calculating the sheet tension changing quantity $\Delta T_1$, the sheet distortion quantity K per a tension of 1 kgf/cm is changed in accordance with the kind of a sheet to be manufactured because of differing in accordance with the kind of the sheet.

Still further, it is also appropriate that, considering the difference between the sheets or the braking torque error, the sheet tension changing quantity $\Delta T_1$ calculated by the foregoing equation (1) is multiplied by a correction coefficient to calculate a tension adjustment quantity.

Moreover, after the phase shift correction tension changing quantity $\Delta T_1$ is calculated in accordance with the aforesaid equation (1) in the step S4, if the calculated tension value obtained by adding the changing quantity $\Delta T_1$ exceeds the maximum tension or the minimum tension, the last calculated tension is maintained.

Thus, according to the first embodiment of this invention, in the tension control unit 19A, the next phase shift quantity $\delta'_3$ is estimated after the consideration of the phase shift quantity occurring during the tension change on the basis of the previous measured phase shift value $\delta_1$ and the present measured phase shift value $\delta_2$, and the tension changing quantity $\Delta T_1$ for the correction of the estimated value $\delta'_3$ is calculated in accordance with the aforesaid equation (1).

In addition, the tension control unit 19A controls the tension adjusting unit 17A to adjust the tension to the single-faced fiberboard sheet $S_1$ by the tension changing quantity $\Delta T_1$, so that it is possible to make the next phase shift quantity $\delta_3$ become zero. Accordingly, the phase shift between the core paper $C_1$, $C_2$ constituting two layers is surely correctable, thus manufacturing a high-quality double-faced corrugated fiberboard sheet S with the core paper $C_1$, $C_2$ constituting two layers.

Moreover, according to this embodiment, since the tension control unit 17A is composed of the braking unit 21, the transmission belt 20, and the guide roll 1 and others, as compared with the case of employing the tension control unit 17 such as a suction box to adjust the tension to be given to the single-faced corrugated fiberboard sheet $S_1$ by a suction force (a frictional resistance force with respect to the single-faced corrugated fiberboard sheet $S_1$), the tension to the single-faced corrugated fiberboard sheet $S_1$ is adjustable within a wider range and with a higher accuracy.

[B] Description of Second Embodiment

Figure 5:
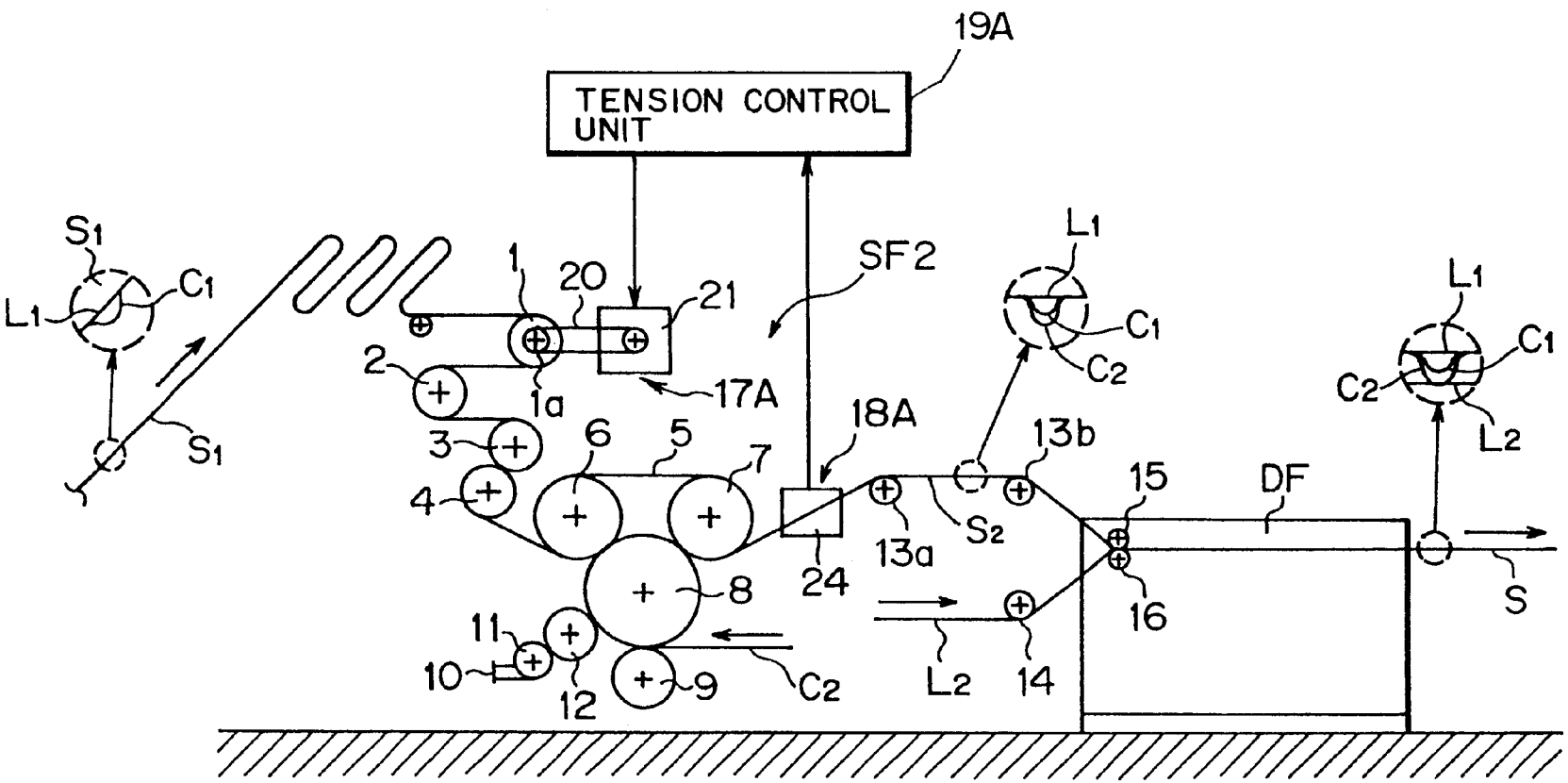
FIG. 5 is a side elevational view illustratively and schematically showing a construction of a corrugated fiberboard sheet manufacturing apparatus equipped with a phase control system according to a second embodiment of this invention.

FIG. 5 is a side elevational view illustratively and schematically showing a construction of a corrugated fiberboard sheet manufacturing apparatus equipped with a phase control system according to a second embodiment of this invention. As shown in FIG. 5, the system according to the second embodiment is constructed substantially like the first embodiment shown in FIG. 3, except that a phase shift measuring unit 18A comprising a CCD camera (image pickup means) 24 is provided in place of the phase shift measuring unit 18 comprising the pulse sensors 22, 23 in the first embodiment. That is, the phase control system according to the second embodiment of this invention is made up of the tension adjusting unit 17A, the phase shift measuring unit 18A and the tension control unit 19A.

In this case, the phase shift measuring unit 18A in this embodiment measures the phase shift quantity $\delta$ between the corrugated configuration of the first core paper $C_1$ of the single-faced corrugated fiberboard sheet $S_1$ and the corrugated configuration of the second core paper $C_2$ to be adhered to the first core paper $C_1$ as well as the phase shift measuring unit 18 in the first embodiment shown in FIGS. 3 and 4, while the phase shift measuring unit 18A in this embodiment photographs the two-layer core single-faced corrugated fiberboard sheet $S_2$ delivered from the second single facer SF2 from a side through the use of the CCD camera 24, and image-analyzes the photography result, thereby measuring the phase shift quantity $\delta$ between the first core paper $C_1$ and the second core paper $C_2$.

That measurement result (phase shift quantity $\delta$) is feedbacked to the tension control unit 19A so that the phase control is done as well as the phase control procedure according to the first embodiment described before with reference to FIGS. 1 and 2.

Thus, the second embodiment of this invention can offer the same effects as those of the above-described first embodiment.

[C] Others

Although the first and second embodiments have been described in the case that the core paper constitute two layers, this invention is not limited to this, but is similarly applicable to the case of manufacturing a corrugated fiberboard sheet with three or more core paper, which can offer the same effects as those of the above-described embodiments.

Figure 7:
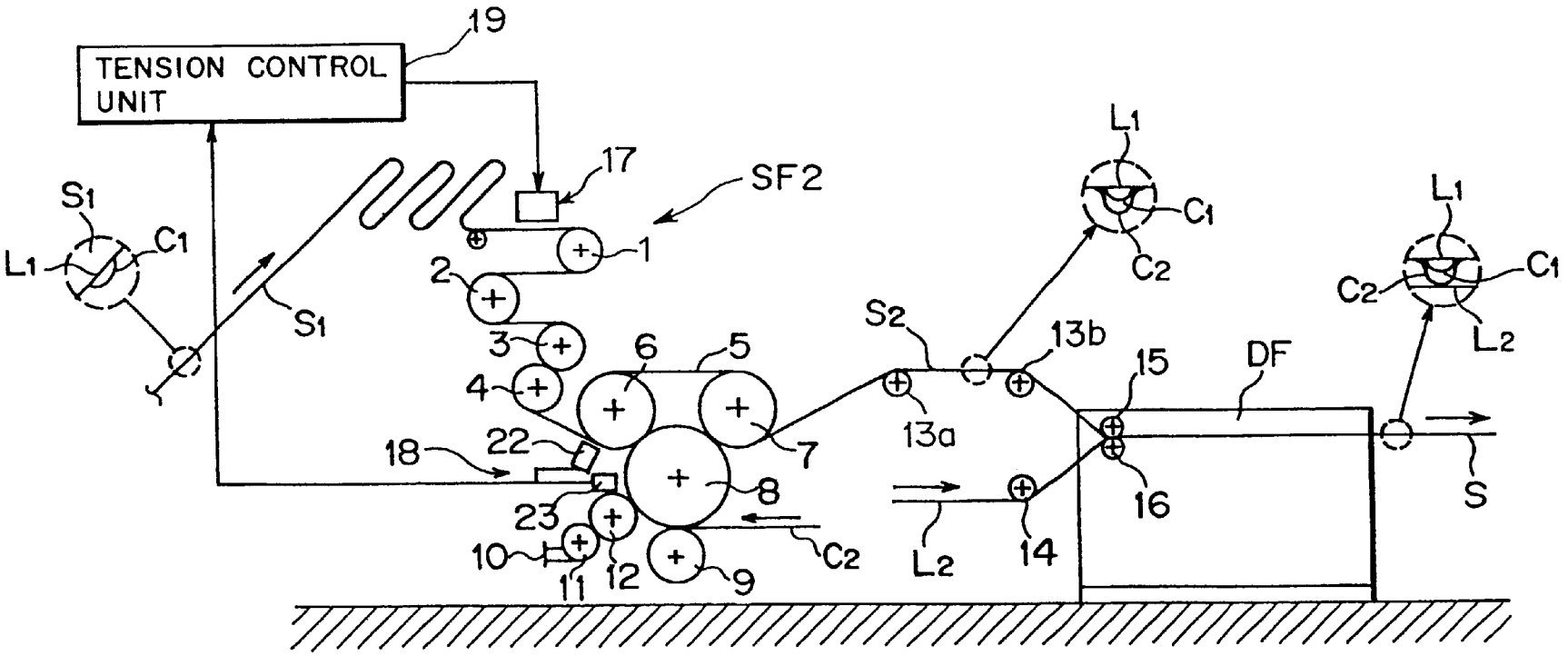
FIG. 7 PRIOR ART
FIG. 7 is a side elevational view illustratively and schematically showing a common corrugated fiberboard sheet manufacturing apparatus for manufacturing a double-faced corrugated fiberboard sheet with two core paper layers.
Figure 8A:
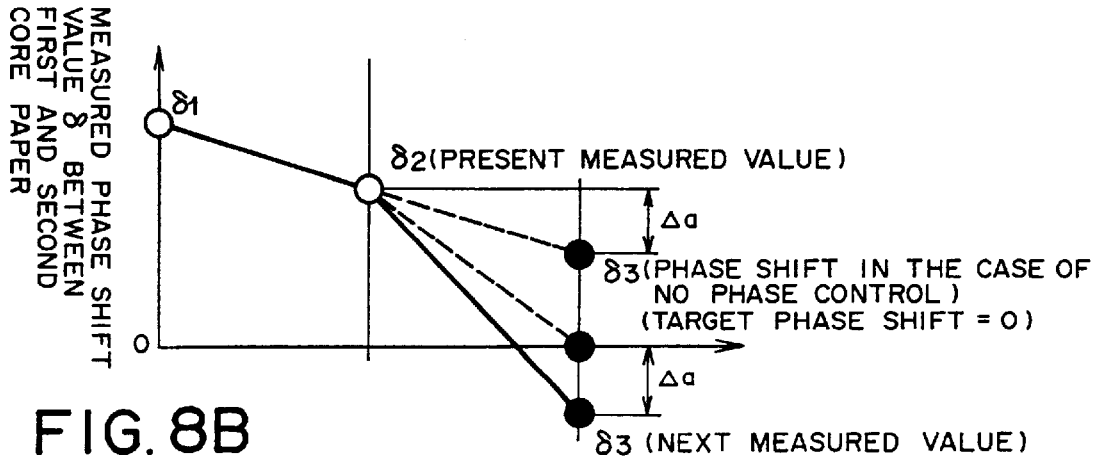
FIG. 8A RELATED ART
FIGS. 8A to 8C are illustrations for explaining a prior phase control method for a corrugated fiberboard sheet with a plurality of core paper layers (a method of calculating a sheet tension changing quantity on the basis of a measured phase shift quantity)
Figure 8B:
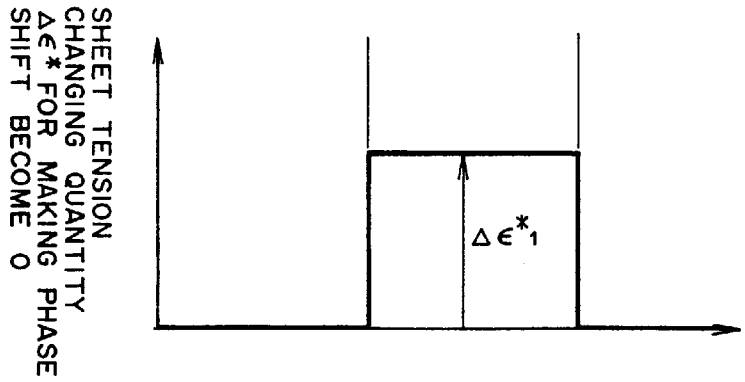
FIG. 8B RELATED ART
Figure 8C:
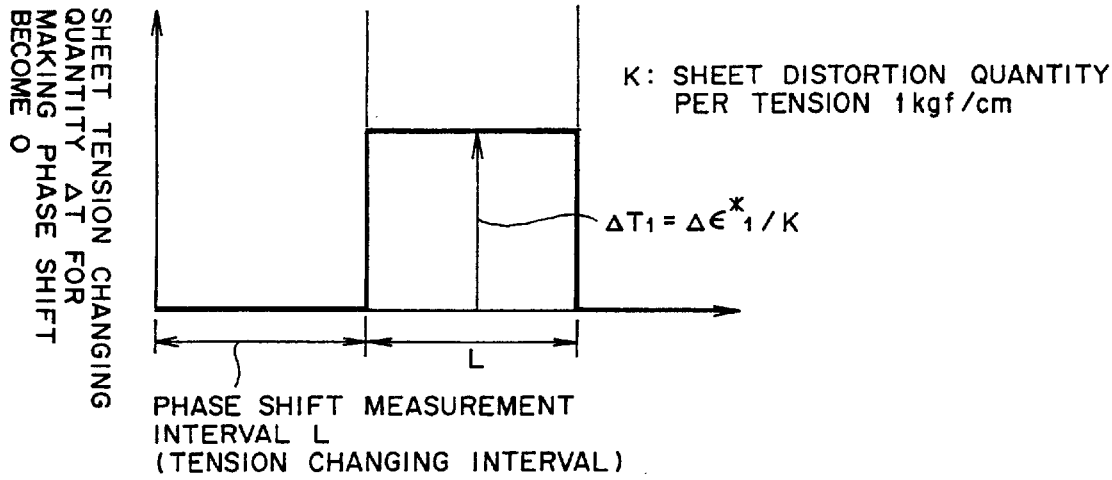
FIG. 8C RELATED ART
Figure 9:
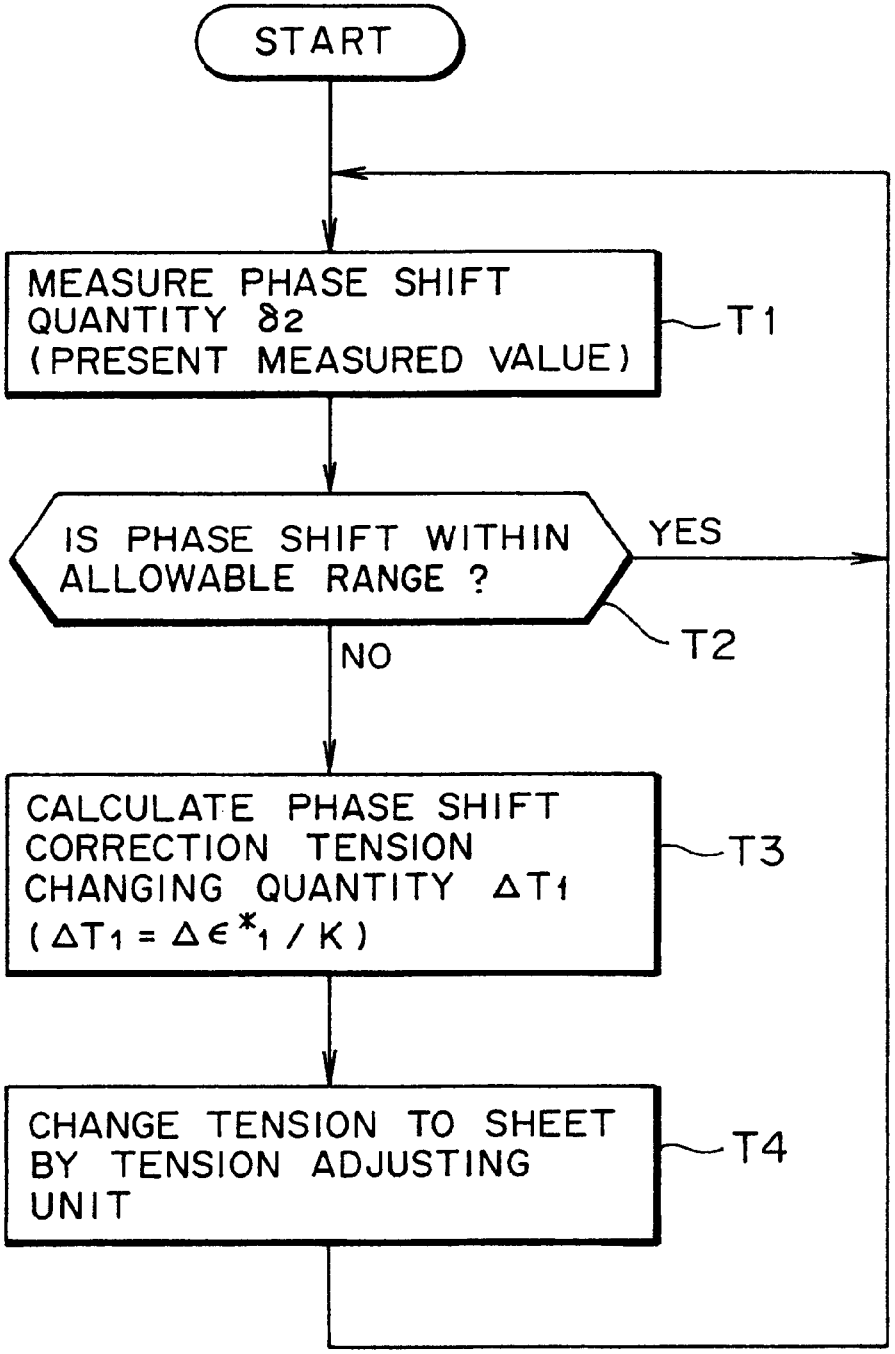
FIG. 9 RELATED ART
FIG. 9 is a flow chart for describing a prior phase control method.
Figure 10:
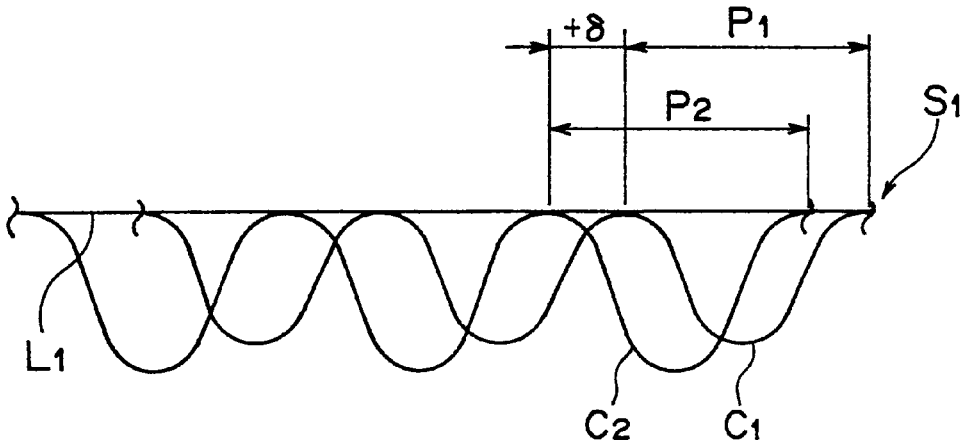
FIG. 10 is an illustrative view showing a state where a phase shift $+\delta$ occurs due to the difference between the crest pitches of core paper.
Figure 11:
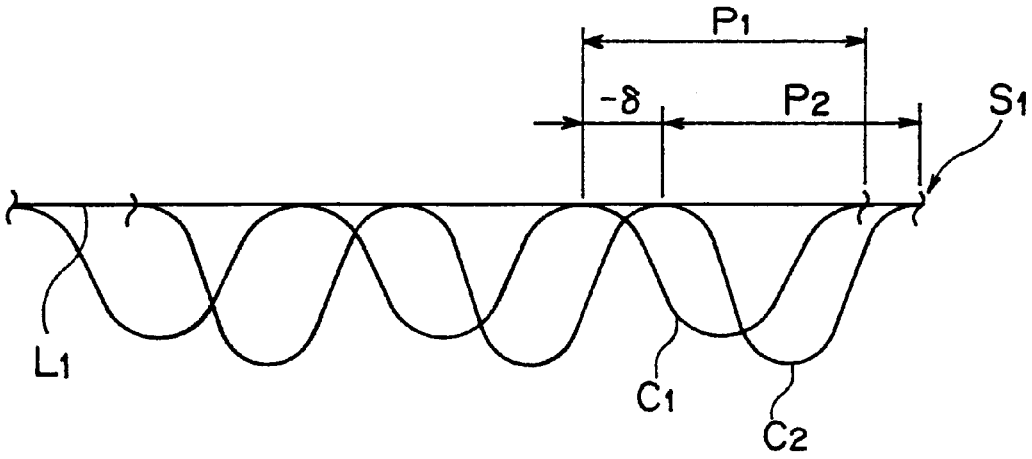
FIG. 11 is an illustrative view showing a state where a phase shift $-\delta$ occurs due to the difference between the crest pitches of the core paper.

In addition, although the tension adjusting unit 17A is composed of the braking unit 21 and others, this invention is not limited to this, and it is also possible to use the tension adjusting unit 17 comprising a suction box or the like shown in FIG. 7.

Moreover, this invention is not limited to the above-described first and second embodiments, but is intended to cover all modifications of the embodiments which do not constitute departures from the spirit and scope of the invention.

What is claimed is:

1. A method for controlling a phase shift between a corrugated configuration of a first core paper web and a corrugated configuration of a second core paper web when the second core paper web is adhered onto the first core paper web, said first core paper web having previously been adhered onto a liner to form a corrugated fiberboard sheet, so as to form a corrugated fiberboard sheet with laminated multi-layer core paper as a final product, said method comprising the steps of:

(a) measuring a series of phase shifts between the corrugated configuration of the first core paper web and the corrugated configuration of the second core paper web at periodic intervals;

(b) obtaining a preceding sheet distortion quantity corresponding to a precedingly measured phase shift value and a current sheet distortion quantity corresponding to a currently measured phase shift value during said step (a);

(c) estimating a next sheet distortion quantity corresponding to a next phase shift to be obtained by a succeeding measurement, based on the preceding sheet distortion quantity and the current sheet distortion quantity obtained in said step (b);

(d) calculating an amount of change to be made in a tension of the corrugated fiberboard sheet so as to compensate the next phase shift, based on the next sheet distortion quantity estimated in said step (c); and (e) adjusting the tension of the corrugated fiberboard sheet during an interval between a current measurement and a succeeding measurement based on the amount of change calculated in said step (d) to thereby control the phase shift between the corrugated configuration of the first core paper web and the corrugated configuration of the second core paper web, wherein in said step (c), the next sheet distortion quantity corresponding to the next phase shift $\delta_3$ is estimated by $2\,\Delta\epsilon^*_1-\Delta\epsilon_1$, where $\Delta\epsilon_1$, is the preceding sheet distortion quantity corresponding to the precedingly measured phase shift value $\delta_1$, and $\Delta\epsilon^*_1$ is the current sheet distortion quantity corresponding to the currently measured phase: shift value $\delta_2$, and in said step (d), the amount of change $\Delta T_1$ is calculated by $(2\Delta\epsilon^*_1-\Delta\epsilon_1)/K$, where K is a sheet distortion quantity per unit tension.

2. A system for controlling a phase shift between a corrugated configuration of a first core paper web and a corrugated configuration of a second core paper web when the second core paper web is adhered onto the first core paper web, which has previously been adhered onto a liner to form a corrugated fiberboard sheet, so as to form a corrugated fiberboard sheet with multi-layer core paper in a laminate as a final product, said system comprising:

phase shift measuring means for measuring a series of phase shifts between the corrugated configuration of the first core paper web and the corrugated configuration of the second core paper web at periodic intervals;

tension adjusting means for adjusting a tension to be given to the corrugated fiberboard sheet; and tension control means for controlling the phase shift between the corrugated configuration of the first core paper web and the corrugated configuration of the second core paper web by 1. obtaining a preceding sheet distortion quantity corresponding to a precedingly measured phase shift value and a current sheet distortion quantity corresponding to a currently measured phase shift value during the measurement by said phase shift measuring means,
2. estimating a next sheet distortion quantity corresponding to a next phase shift to be obtained by a succeeding measurement with said phase shift measuring means, based on the preceding sheet distortion quantity and the current sheet distortion quantity,
3. calculating an amount of change to be made in a tension of the corrugated fiberboard sheet so as to compensate the estimated next phase shift, based on the estimated next sheet distortion quantity, and
4. adjusting the tension given to the corrugated fiberboard sheet by said tension adjusting means during an interval between a current measurement and a succeeding measurement based on the calculated amount of change, wherein said tension control means is operable to estimate the next sheet distortion quantity corresponding to the next phase shift $\delta_3$ by $2\Delta\epsilon^*_1-\Delta\epsilon_1$, where $\Delta\epsilon_1$ is the preceding sheet distortion quantity corresponding to the precedingly measured phase shift value $\delta_1$, and $\Delta\epsilon^*_1$ is the current sheet distortion quantity corresponding to the currently measured phase shift value $\delta_2$, and to calculate the amount of change $\Delta T_1$ as $(2\Delta\epsilon_1^*-\Delta\epsilon_1)/K$, where K is a sheet distortion quantity per unit tension.

3. A system as defined in claim 2, wherein said phase shift measuring means includes a first pulse sensor for detecting a series of ridges of the first core paper web and outputting a result of the detection as a first pulse signal, and a second pulse sensor for detecting a series of ridges of the second core paper web and outputting a result of the detection as a second pulse signal, and said phase shift measuring means is operable to carry out the measurement of phase shift based on the first pulse signal from said first pulse sensor and the second pulse signal from said second pulse sensor.

4. A system as defined in claim 3, wherein said tension adjusting means includes:

one or more rolls around which the corrugated fiberboard sheet is to be wound; and a braking unit for changing a braking force with respect to said one or more rolls.

5. A system as defined in claim 2, wherein said phase shift measuring means includes image pickup means for successively photographing the final product from a side of the final product, and said phase shift measuring means is operable to carry out the measurement of phase shift through image analysis of the photography result by said image pickup means.

6. A system as defined in claim 2, wherein said tension adjusting means includes:

one or more rolls around which the corrugated fiberboard sheet is to be wound; and a braking unit for changing a braking force with respect to said one or more rolls.

* * * * *